United States Patent [19]

Roberts et al.

[11] Patent Number: 4,808,038

[45] Date of Patent: Feb. 28, 1989

[54] METHOD FOR INSTALLING A HOLLOW CLOSED BOTTOM PILE

[75] Inventors: David L. Roberts; Robert B. Stewart; Peter K. Currie, all of Rijswijk, Netherlands

[73] Assignee: Shell Oil Company, Houston, Tex.

[21] Appl. No.: 42,400

[22] Filed: Apr. 24, 1987

[30] Foreign Application Priority Data

Apr. 25, 1986 [GB] United Kingdom ..... 8610221

[51] Int. Cl.[4] ..... E02D 3/12; E02D 5/46

[52] U.S. Cl. ..... 405/237; 405/233; 405/264

[58] Field of Search ..... 405/224, 225, 227, 228, 405/233, 237, 244, 248, 264; 166/294, 295

[56] References Cited

U.S. PATENT DOCUMENTS

| | | | |
|---|---|---|---|
| 2,428,070 | 9/1947 | Frenkil | 61/53 |
| 3,306,355 | 2/1967 | Maly | 405/264 X |
| 3,324,665 | 6/1967 | Robichaux et al. | 405/264 X |
| 3,354,657 | 11/1967 | Turzillo | 61/53.5 |
| 3,636,717 | 1/1972 | Pogonowski et al. | 405/244 X |
| 3,677,113 | 7/1972 | Bowles | 405/225 |
| 4,331,722 | 5/1982 | Packo | 405/264 X |
| 4,370,078 | 1/1983 | Gadelle | 405/264 |
| 4,543,764 | 10/1985 | Kozikowski | 52/746 |
| 4,618,289 | 10/1986 | Federer | 405/236 |

*Primary Examiner*—David H. Corbin

[57] ABSTRACT

The invention relates to a method for installing a hollow pile into an earth formation. The pile is provided with a closed bottom and perforations in a section of its wall near the bottom end and/or bottom closing plate. In this method, the pile is driven into the earth formation and liquid thermo-setting resin-forming composition is displaced through the pile and the perforations to permeate the formation where it solidifies and forms a consolidated mass. The liquid thermosetting resin-forming composition comprises:

10–25%v—Epikote - 828
2.5–10%v—MDA
12.5–30%v—Butyloxitol
0.25–2.5%v—DMP-10
0.5–5%v—Kerosene, and
37.5–65%v—Xylene.

9 Claims, 1 Drawing Sheet

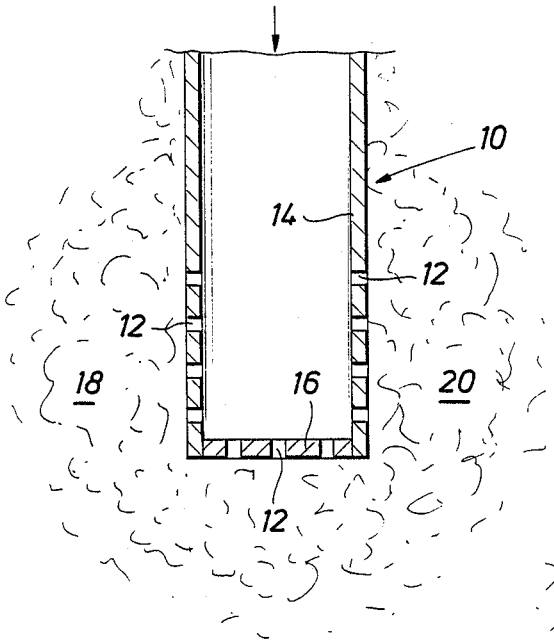
FIG. 1
FIG. 3
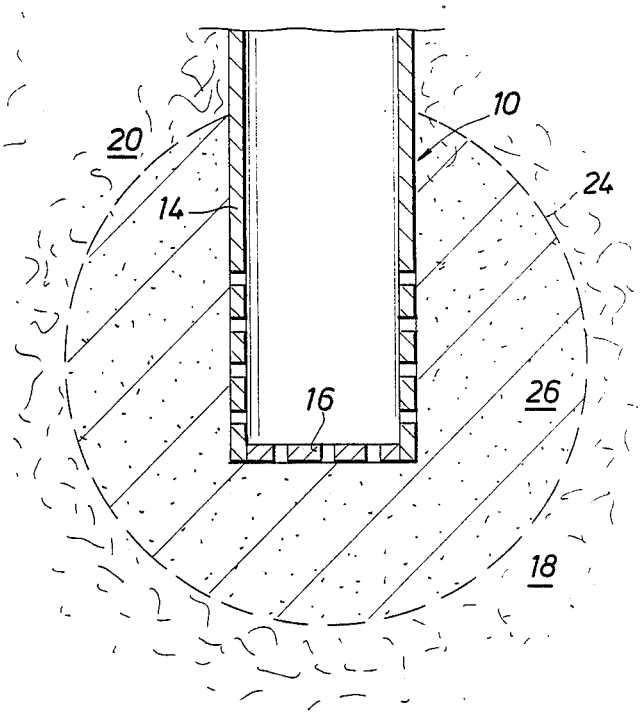
FIG. 2
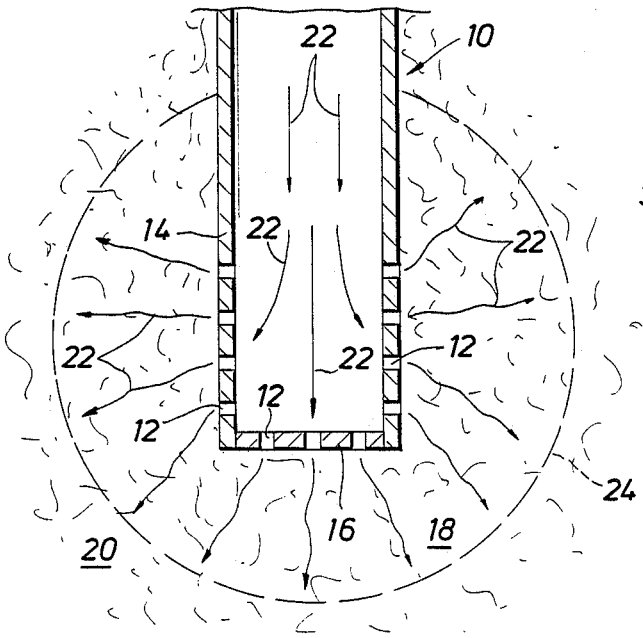
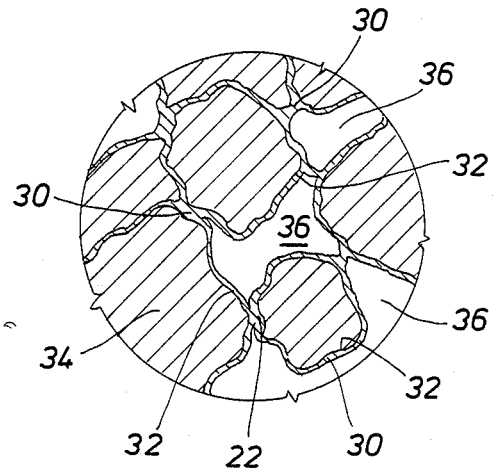
FIG. 4

METHOD FOR INSTALLING A HOLLOW CLOSED BOTTOM PILE

BACKGROUND OF THE INVENTION

This invention relates to a process for installing and stabilizing piles in earth formations. More particularly, the invention is directed to a method for stabilizing and increasing the load bearing capacity, especially with respect to the pull-out resistance, of piles, such as those used to support or stabilize offshore structures and drilling platforms. The invention is especially useful in processes in which hollow piles are embedded in earth formation and stabilized by emplacing and solidifying liquids within radial zones that extend from within the piles out into the surrounding earth formations.

There is frequent need for stationary foundations or pile structures that will neither yield to the weight of any super-structure placed thereon nor yield to external pull-out forces. The problem of providing such a pile structure becomes especially difficult when it is desired to erect a super-structure above an earth stratum consisting of incompetent earth formations such as loose or sandy earth. Such formation tend to require the driving of very long piles to provide the required load carrying capacity. For example, in the oil industry, serious problems have arisen in connection with the stabilization of pile structures used to support offshore drilling and production platforms, when such pile structures are embedded in incompetent earth formations on the ocean floor. In addition to the weight of the platform structures per se, the pile structures must be able to withstand the extreme pull-out forces resulting from the constant pounding and over-turning forces of water waves and currents against the platform. More recently, such platforms have been subjected to even more violent pull-out forces due to the action of ice-flow in certain arctic regions.

In the ordinary smooth-walled pile an upward axial stress is transmitted to the earth largely or wholly by skin friction. These piles are "driven to refusal," i.e., driven to a depth at which the skin friction and the load-bearing capacity of the formations penetrated becomes sufficient to resist further penetration in response to the driving force. It is also known to form projections or footings on embedded pile structures to act as anchoring means for the piles. Such projections or footings as are known in the prior art consist of metal extensions and the like and are reasonably effective as stabilizers when the pile is embedded in hard earth or stone. However, such a metal projection is of little or no value when the pile structure is embedded in less consolidated earth, such as sandy or loose soil. Thus, the need for a method which will effectively secure a pile structure in incompetent earth formations is apparent. Such a method is provided by the invention.

SUMMARY OF THE INVENTION

The invention relates to a method for installing a hollow pile into an earth formation. The pile is provided with a closed bottom and perforations in a section of its wall near the bottom end and/or bottom closing plate. In this method, the pile is driven into the earth formation and a liquid thermo-setting resin-forming composition is displaced through the pile and the perforations to permeate the formation where it solidifies and forms or consolidated mass. The liquid thermosetting resin-forming composition comprises:

10–25% v—Epikote-828
2.5–10% v—MDA
12.5–30% v—Butyloxitol
0.25–2.5% v—DMP-10
0.5–5% v—Kerosene
37.5–65% v—Xylene

BRIEF DESCRIPTION OF THE DRAWINGS

The above brief description, as well as further objects, features, and advantages of the present invention will be more fully appreciated by reference to the following detailed description of the presently preferred, but nonetheless illustrative, embodiment of the present invention with reference to the accompanying drawings in which:

FIG. 1 is a cross-sectional view of the pile being driven into an earth formation in accordance with the present invention;

FIG. 2 is a cross-sectional view of a resin-forming composition being displaced into an unconsolidated portion of the earth formation in accordance with the present invention;

FIG. 3 is a cross-sectional view of a pile embedded within a consolidated mass integrally comprising the zone permeated by the now hardened resin-forming composition and the pile; and FIG. 4 is a close-up cross-sectional view of an earth formation after installation of a pile in accordance with the present invention.

DETAILED DESCRIPTION OF THE PREFERRED EMBODIMENTS

In more detail, the present invention is a method for installing a hollow, closed-bottom pile 10 having perforations 12 in a section of the wall 14 near the bottom end thereof and/or in the bottom closing plate 16, in an earth formation. The method includes driving the pile into an earth formation 20 which tightly engages the outer surface of the pile, at least along the perforated section 12, when the driving is completed. See FIG. 1. The perforated section of the pile 10 is disposed within an unconsolidated portion 18 of said earth formation and a liquid thermo-setting resin-forming composition 20 is displaced through the pile and the perforations. See FIG. 2. The liquid composition permeates the unconsolidated portion of the formation in a radially extensive zone 24 that is continuous from within the piling out into the unconsolidated portion and the liquid composition solidifies in the radially extensive zone to form a consolidated mass 26 integrally comprising the permeated zone and the pile. See FIG. 3. The liquid thermosetting resin-forming composition employed in the method contains:

10–25% v—Epikote-828
2.5–10% v—MDA
12.5–30% v—Butyloxitol
0.25–2.5% v—DMP-10
0.5–5% v—Kerosene
37.5–65% v—Xylene.

EPIKOTE-828 is a trade name for commercial liquid polyglycidyl ether of 2,2-bis(4-hydroxyphenyl)propane, which preferably has an epoxy group content of 5320 mmol/kg.

MDA means diaminodiphenylmethane:

-continued

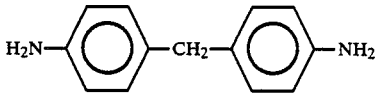

Butyloxitol is 2-butoxyethanol:

$CH_3-(CH_2)_3-O-CH_2-CH_2-OH$

DMP-10 is dimethylaminomethylphenol:

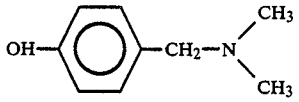

and its isomers.

Preferably the liquid thermo-setting resin-forming solution has the following composition:

15–20% v—Epikote 828
4–7% v—MDA
20–27% v—Butyloxitol
0.5–1.0% v—DMP-10
2.0–4% v—Kerosene
45–60% v—Xylene Broadly, the process according to the present invention comprises stabilizing a struture embedded in an earth formation by disposing the solidifiable liquid resin composition between at least an external portion of the structure and the surrounding earth formation, and solidifying the resin composition in intimate and static contact with both the structure and the formation, whereby the solidified resin is bonded to both the structure and the formation.

When resin-forming polyepoxide composition 22 is flowed, as a liquid, from inside the pile 10 into contact with a surrounding earth formation 20 (especially a granular earth formation) and allowed to harden in accordance with its present invention, the pile demonstrates a pull-out resistance materially exceeding that obtainable by other methods. Thus it is possible, to reduce both the number of piles necessary to form an adequate foundation and the depth to which such piles must be driven.

The prior art processes of anchoring pilings, such as by forming metal footings or by pouring slurries of concrete, or other cementitious materials around or from within the pile out into the surrounding earth, are subject to serious disadvantages which materially reduce the pullout resistance of the piles when compared with those installed by our new process. More specifically, concrete slurries cannot easily be pumped through permeable formations without fracturing the formations.

Furthermore, cement does not have a high bonding affinity for metal and tends to fracture at the point where it is joined to a metal pile when the latter is subjected to intense or shock-loading pull-out forces.

By using the resin-forming composition 22 according to the invention, the aforementioned disadvantages of prior art metal footings or cementitious projections are overcome. The composition according to the invention comprises a pumpable, oil-phase liquid mix which is not affected by water, i.e., it will not dehydrate or dilute and become an unpumpable mass, as will concrete or cement. Further, the present liquid compositions solidify at predictable rates in contact with sea water and other aqueous solutions which materially affect the curing or setting of cement.

In addition, the present liquid mix may be used to stabilize piles 10 in relatively permeable formations, where prior art cementitious materials are not effective because the suspended solid particles which, in such prior art mixtures, are essential to the formation of a solid grout, filter out on the face of the formation. Since the mix is a solid free, pumpable, oil-phase liquid, the mix cures to a solid whether it is disposed within or adjacent to the matrix of the earth formation and thus it can be cured in either sandy formations or in relatively impermeable formations.

Furthermore, the liquid mix according to the invention will adhere to wet surfaces and solidify to form a much stronger bond to the metal pilings and to the earth formations than any material previously known. Tests have shown that under identical conditions the cured mix exhibited a shear strength of from at least 2 to 100 times as great as that for cementitious compositions. Finally, the solidified resin composition according to the invention is elastic rather than brittle and resists shock better than concrete.

While resin consolidations, especially where the formation is completely saturated with the resin are excellent, the relatively high cost of the resins may prohibit such consolidations.

When the formation to be consolidated must remain permeable, it is not possible to saturate the formation with resins since this would close off the pore space between the adjacent grains of the formations making the resulting consolidated formation completely impermeable. In order to maintain permeability and a corresponding reduction in cost, resins are dispersed in formations in concentrations less than saturating to achieve some consolidation and, at the same time, maintain permeability. However, when the concentration of the resin is reduced, much of the resin merely collects and coagulates in the pore spaces between adjacent grains of the formation without adding appreciably to the actual consolidation or the compressive strength of the consolidated grains. Therefore, it has been a widespread practice to attempt a compromise between some consolidation and some permeability, when it is necessary that the formation consolidated remain permeable.

The method according to the invention seeks to avoid such compromises by the formation of a hardened resin film 30 covering the surfaces 32 of the loose grains 32 and leaves the pores (interstitial voids) 36 unencumbered by resin precipitation. See FIG. 4. In this manner, it is possible to achieve consolidations which are both strong and permeable, and which can be accomplished at a very reasonable expense. Surprisingly, the consolidations accomplished according to the invention, are as strong as those consolidations in which the formation is actually saturated with the resin or resin composition. This means that excellent consolidations can be achieved at a very reasonable cost while maintaining a very high permeability. Permeable consolidations allow the consolidated mass to drain and thereby allow it to sustain much greater loads than in the case in which drainage is not possible. Often, in the practice of the invention, the permeability of the consolidated mass is approximately that of the unconsolidated mass which makes this method extremely desirable for the consolidation in case one desires to repeat the consolidation treatment to give additional strength to part or whole of the initially consolidated mass.

While it has been the practice to treat permeable, unconsolidated or partially consolidated masses with injected resin compositions to obtain consolidation, the consolidation integrity is sometimes sacrificed for purposes of permeability. It has now been found that a considerable increase in consolidation integrity can be achieved by resin compositions when a silane is present in the liquid composition to be injected into formation to be consolidated. The silanes have at least one functional group which is capable of reacting with the grains of the formation and another function group which is capable of reacting with the resin-forming composition with which the consolidation is to be accomplished. Thus, the silane ensures a connecting link between the resin and the grains of the formations and thereby ensures greater consolidation integrity. Also, the presence of the silane tends to prevent the resin from accumulating in the pore space between adjacent grains and causes the resin composition to adhere closely to the surface of the grains being consolidated. Under such circumstances, the resin does not coagulate in the pores and leaves the consolidated formation relatively permeable while also achieving high consolidation integrity.

Therefore, according to a preferred embodiment of the invention, the liquid thermo-setting resin-forming composition contains a silane, advantageously in a concentration within the range of from 0.5 to 2% v.

The liquid thermo-setting resin-forming composition preferably has a dynamic viscosity of at most 10 cP. By using such a composition, the soil to be consolidated under and/or around a pile is not disturbed during the injection of the liquid composition therein.

The liquid composition can be injected through holes in the lower cylindrical part of the pile: shaft-grouting. Alternatively it can be injected through holes in the bottom closing plate of the pile: pile-tip-grouting.

The invention will now be further illustrated by the following Example.

EXAMPLE

Platform A is an offshore piled structure constructed for the exploitation of hydrocarbon reserves. The main part of the structure rests on four legs in 150 m deep sea. Each leg is piled (by a number of hollow steel piles placed symmetrically around the leg) through the sea-bed to a depth of 120 m below the sea-bed. The pile tips rest in a weakly cemented, porous calcareous soil of low permeability (20–400 millidarcy) which has subsequently been shown in tests as having insufficient strength to safely bear the load of the platform according to the original design criteria.

As a remedial action, a treatment based on the epoxy grout formulation mentioned hereinbelow was carried out as follows.

Calculations showed that in order to satisfactorily strengthen the soil beneath the pile tips, a five-fold increase in soil strength would be required and this must extend up to 1.7 m radially from the axis of the pile and to a depth of 6 m below the pile tip. The volume of epoxy grout required was of the order of 25 cubric meters per pile. An injection hole of 15 cm diameter was drilled through the pile tip into the soil, extending some 6 m beneath the pile tip. The following fluids were injected into the soil taking care not to exceed the estimated fracture pressure of the soil (approximately 12 bar):

Fresh water
Isopropyl alcohol
Xylene

The purpose of these fluids was to pre-condition the formation by removing most of the natural pore water. This was followed by the epoxy grout. The pumping rate averaged 1.5 cu.m per hour at 10 bar over-pressure. In total 48 cu.m of epoxy grout were pumped in 31 hours (for the purposes of this test more epoxy grout was pumped than actually required).

In order to evaluate the effectiveness of the epoxy grout treatment, boreholes were drilled into the treated zone and soil samples were recovered for testing. Soil strengths were found to have improved by a factor 10 and epoxy grout was found up to 2.6 m away from the injection borehole.

The liquid thermo-setting resin-forming composition (the so-called expoxy grout used in this Example) was composed by blending equal volumes of solutions A and B, having the following compositions:

| | |
|---|---|
| COMPONENT A | |
| EPIKOTE-828 | 33% v |
| XYLENE | 66% v |
| SILANE (D.C. Z6040) | 0.72% v |
| COMPONENT B | |
| MDA | 11% v (127 g/l) |
| XYLENE | 35% v |
| BUTYL OXITOL | 47% v |
| DMP-10 | 1.4% v |
| KEROSENE | 5.6% v |

What is claimed is:

1. A method for installing a hollow, closed-bottom pile having perforations in a section of the wall near the bottom end thereof and/or in a bottom closing plate, in an earth formation comprising:

driving said pile into the earth formation, said earth formation tightly engaging the outer surface when said driving is completed;

disposing said perforated section of said pile within an unconsolidated portion of said earth formation;

displacing through said pile and said perforations a liquid thermosetting resin-forming composition which comprises:

10–25% v liquid polyglycidyl ether of 2,2-bis(4-hydroxyphenyl) propane;
2.5–10% v diaminodiphenylmethane;
12.5–30% v 2-butoxyethanol;
0.25–2.5% v dimethylaminomethylphenol;
0.5–5% v Kerosene; and
37.5–65% v Xylene;

permeating said unconsolidated portion of said formation with said liquid composition in a radially extensive zone that is continuous from within the piling out into said unconsolidated portion; and solidifying said liquid composition in said radially extensive zone to form a consolidated mass integrally comprising said permeated zone and said pile.

2. A method as claimed in claim 1, wherein the liquid thermo-setting resin-forming composition comprises:

15–20% v liquid polyglycidyl ether of 2,2-bis(4-hydroxyphenyl) propane;
4–7% v diaminodiphenylmethane;
20–27% v 2-butoxyethanol;
0.5–1.0% v dimethylaminomethylphenol;
2.0–4% v Kerosene; and
45–60% v Xylene.

3. A method as claimed in claim 1 wherein the liquid thermo-setting resin-forming composition further contains a silane.

4. A method as claimed in claim 3, wherein the liquid composition contains 0.5–2% v silane.

5. A method as claimed in claim 1 wherein the dynamic viscosity of the liquid composition is at most 10 cP.

6. A method as claimed on claim 1, further comprising a step of the liquid thermo-setting resin-forming composition comprising:

preparing a solution A having the following composition:

liquid polyglycidyl ether of 2,2-bis(4-hydroxyphenyl) propane: 33% v,

Xylene: 66% v,

Silane: 0.72% v, preparing a solution B having the following composition:

diaminodiphenylmethane: 11% v,

Xylene: 35% v, 2-butoxyethanol: 47% v, dimethylaminomethylphenol: 1.4% v kerosene: 5.6% v; and blending equal portions of Solution A and Solution B.

7. A method as claimed in claim 1 further comprising:

removing natural pore water from the earth formation.

8. A method as claimed in claim 7 wherein removing the natural pore water comprises:

injecting fresh water through the pile and perforations and into the earth formation at a pressure less that the fracture pressure of the earth formation;

injecting isopropyl alcohol through the pile and perforations and into the earth formation at a pressure less than the fracture pressure of the earth formation; and injecting xylene through the pile and perforation and into the earth formation at a pressure less than the fracture pressure of the earth formation.

9. A method as claimed in claim 1 further comprising forming a hardened resin film covering surfaces of loose grains within the formation, but leaving the pores of the formation substantially unencumbered by resin precipitation, said step comprising:

presenting a silane within the liquid thermo-setting resinforming composition in a concentration of 0.5 to 2.0% v;

reacting a first functional group of the silane with the grains of the formation; and reacting a second functional group with the thermo-setting resin-forming composition.

* * * * *